United States Patent [19]

Tress et al.

[11] 4,060,228

[45] Nov. 29, 1977

[54] PULL-FOOT FEED

[75] Inventors: Norwood E. Tress, Bath; Winston A. Orsinger, Bethlehem, both of Pa.

[73] Assignee: Bell & Howell Company, Phillipsburg, N.J.

[21] Appl. No.: 709,826

[22] Filed: July 29, 1976

Related U.S. Application Data

[63] Continuation-in-part of Ser. No. 608,970, Aug. 29, 1975, Pat. No. 4,013,283.

[51] Int. Cl.[2] ..... B65H 3/08; B65H 3/50

[52] U.S. Cl. ..... 271/14; 271/100; 271/106; 271/115

[58] Field of Search ..... 271/11, 14, 20, 99–102, 271/106, 115, 119, 120, 171, 262, 263, 272, 273

[56] References Cited

U.S. PATENT DOCUMENTS 3,741,535 6/1973 Palkovic et al. ..... 271/101

*Primary Examiner*—Robert W. Saifer

*Attorney, Agent, or Firm*—Griffin, Branigan and Butler

[57] ABSTRACT

In a modified embodiment of the pull-foot sheet feeding device described in U.S. application Ser. No. 608,970, filed Aug. 29, 1975, now Pat. No. 4,013,283 the bottom roller is replaced by a roller segment. The roller segment is pivotally mounted on a carrier which is fixedly mounted on a driving shaft. The pivotal axis of the roller segment is offset from the axis of the driving shaft. The roller segment has an outer surface for pinching sheets between it and the pull-foot while rolling on a sheet in response to rotation of the driving shaft. The position of the roller segment relative to the carrier is constrained by a spring, which provides biasing of the roller segment surface against the pull-foot, and an adjustable stop. The pull-foot is driven outwardly to pull sheets from a hopper by the roller segment but is under the control of a biasing spring and cam during its return.

6 Claims, 1 Drawing Figure

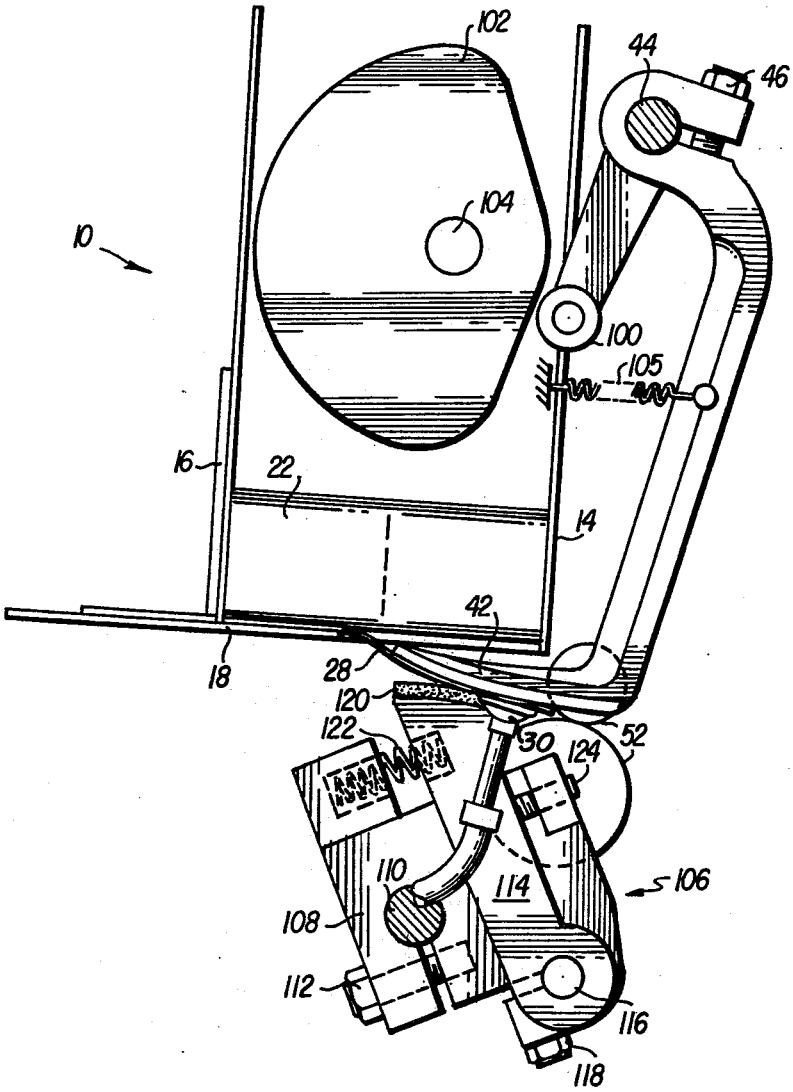
102
44
46
104
10
100
105
16
22
14
42
18
28
120
122
30
124
52
110
114
106
108
112
116
118

PULL-FOOT FEED

BACKGROUND OF THE INVENTION

The invention relates to a modified embodiment of the pull-foot sheet feeding device described in U.S. patent application Ser. No. 608,970 filed on Aug. 29, 1975 now U.S. Pat. No. 4,013,283 and assigned to the same assignee as the instant case. In this respect, application Ser. No. 608,970 is incorporated herein by reference in accordance with the guidelines set out in the Manual of Patent Examining Procedure, paragraph 608.01 (p) and the present application is a continuation-in-part of Application Ser. No. 608,970.

The pull-foot sheet feeding device described in application Ser. No. 608,970 basically includes a "pull-foot" which oscillates between a sheet stack and sheet transfer rolls. To initiate feeding the pull-foot moves below the sheet stack and a lower-most separated sheet. A roller is concurrently moved into position to pinch the separated sheet between the pull-foot and the roller. The pull-foot is oscillated away from the stack and, in doing so, the outer sheet is pulled from the stack by interaction between the pull-foot and the roller. It is explained in that application that either the pull-foot or the roller can supply the force which pulls sheets out of the sheet stack.

A problem with a normal roller as is depicted in the above mentioned application is that it is sometimes difficult to obtain sufficient pinching force between such a roller and the pull-foot to pull sheets from tall, heavy stacks. Thus, it is an object of this invention to provide another embodiment of the pull-foot sheet feeding device which provides greater pinching force than the device depicted in the above mentioned application.

Another difficulty with the device described in the above mentioned application is that it requires a greater amount of moving parts than is necessary. That is, the axis of the roller is moved laterally to produce "pinching." Therefore, it is another object of this invention to provide a pull-foot mechanism in which primarily rotary motion of a roller element is required to pinch sheets against the pull-foot.

Yet another difficulty with the pull-foot sheet feeding mechanism described in the prior application is that undue adjustments must be made to achieve proper pinching force between the bottom roller and the pull-foot for various paper-stock weights. Thus, it is another object of this invention to provide a pull-foot mechanism which requires minimum adjustment to service various paper stock weights.

SUMMARY OF THE INVENTION

According to principles of this invention, the bottom roller employed in the above-mentioned previously-filed application is replaced by a roller segment which is driven only in a rotary manner by a driving shaft. The roller segment is pivotally mounted on a carrier which is affixed to the driving shaft. A pivot mount for the roller segment is offset from the axis of the driving shaft. The roller segment has a surface for pinching sheets between it and the pull-foot while rolling on the sheet in response to rotation of the driving shaft. The range of pivotal movement of the roller segment about its pivotal mount is controlled in one direction by a spring and in the other direction by an adjustable stop. When the surface of the roller segment contacts the pull-foot the spring biases the roller segment surface toward the pull-foot.

The pull-foot includes a biasing spring for biasing it inwardly toward a sheet stack but it is carried outwardly by the roller segment. A cam is included for controlling the return of the pull-foot toward the sheet stack.

BRIEF DESCRIPTION OF THE DRAWING

The foregoing and objects, features and advantages of the invention will be apparent from the following more particular description of the preferred embodiment of the invention, as illustrated in the accompanying drawing. The drawing is not necessarily to scale, emphasis instead being placed upon illustrating principles of the invention in a clear manner.

The drawing is a simplified side view of a pull-foot sheet feeding mechanism employing principles of this invention at only one position of its operational sequence.

DESCRIPTION OF A PREFERRED EMBODIMENT

In describing the device depicted in the drawing, the same reference numerals as were employed in application Ser. No. 608,970 filed Aug. 29, 1975 will be used to identify corresponding elements. Reference numerals above one hundred will be used to identify elements which were not disclosed in the previous application.

A main hopper assembly 10 comprises a vertical front plate 14, a vertical rear plate 16 and a bottom plate 18. Stacked sheets 22 are placed in the main hopper assembly 10 with their foremost ends extending beyond the bottom plate 18.

A reciprocating suction cup 30, which is disclosed in the incorporated-by-reference application, pulls the forward edge of the bottom-most sheet 28 downwardly from the stacked sheets 22.

A pull-foot 42 is mounted on a shaft 44 by a clamp screw 46. The pull-foot's shaft 44 is attached to a cam follower 100 which cooperates with a cam 102 in a manner described below. The cam 102 is driven by a cam shaft 104. The pull-foot 42 is biased toward the stacked sheets 22 to the position depicted in the drawing by a spring 105.

A roller-segment mechanism 106 is positioned below the stacked sheets 22. The roller segment mechanism 106 includes a main carrier 108 which is clamped onto a driving shaft 110 by a clamp screw 112. A roller segment 114 is pivotally mounted on a pin 116 which is clamped to the main carrier 108 by a clamp screw 118. It should be noted that the axis of the pin 116 is offset from the axis of the driving shaft 110. The roller segment 114 has a friction surface 120 which is constructed of a polymer material. The friction surface 120 is biased toward the sole of the pull-foot 42 by a spring 122 when the friction surface 120 is in contact with the pull-foot 42. In this respect, the spring 122 is loaded between the roller segment 114 and the main carrier 108. The roller segment 114 is prevented from rotating about the pin 116 beyond a certain point by an adjustable set screw 124 which is also mounted to a portion of the main carrier 108.

Describing the operation of the pull-foot feeding mechanism depicted in the drawing, the bottom-most sheet 28 is separated from the stacked sheets 22 by a vacuum separator and the pull-foot 42 enters the space between the stacked sheets 22 and the bottom-most sheet 28 to a position as is depicted in the drawing. At this point, the driving shaft 110 is at a position such that the friction surface 120 clamps the bottom-most sheet 28 between the friction surface 120 and the pull-foot 42. The pull-foot 42 is driven outwardly, in a counterclockwise direction as seen in the drawing, by the roller segment 114 with the bottom-most sheet 28 being carried between the friction surface 120 and the pull-foot 42. Eventually, the bottom-most sheet 28 is gripped by transfer rollers 52 and transported away from the stacked sheets 22.

Once the transfer rollers 22 have gripped the bottom-most sheet 28, the cam 102 catches up to the cam follower 100 and controls the pull-foot 42 to avoid fowling of the sheet 28 that was gripped by the transfer rollers 52. Thereafter, the roller segment 114 is returned to a position for clamping the next bottom-most sheet between it and the pull-foot. That is, the roller segment is driven by the driving shaft 110 to a position similar to the position shown in the drawing, but rotated somewhat in a counterclockwise direction therefrom. In one embodiment, the driving shaft 110 oscillates backwardly, in a counterclockwise direction, to arrive at this position, and in another embodiment it rotates continuously in a clockwise direction to return to this position.

The pull-foot 42 is held outwardly by the cam 102 until the next bottom-most sheet 28 is separated from the stacked sheets 22. At this point, the cam 102 allows the spring 105 to pull the pull-foot 42 between the next bottom-most sheet 28 and the stacked sheets 22.

It should be noted that the friction surface 120 is not rounded on a radius formed about the pin 116, but rather upon an approximate radius of the driving shaft 110. Such an arrangement allows the biasing spring 122 to bias the surface 120 of the roller segment 114 against the pull-foot 42 by rotating the roller segment 114 about the pin 116. Thus, the pulling force has a component which grips the sheet firmly to the pull-foot. Such biasing provides sufficient pinching force between the roller segment 114 and the pull foot 42 and also allows variation in sheet thickness without adjustment. Depending on stock weight, the roller segment will accommodate changes in forms having as many as four pages without requiring adjustment. When adjustment is required, this is provided by the adjustable set screw 124.

While the invention has been particularly shown and described with reference to preferred embodiments thereof, it will understood by those skilled in the art that various alterations in form and detail may be made therein without departing from the spirit and scope of the invention.

The embodiments of the invention in which an exclusive property or privilege is claimed are defined as follows:

1. In a sheet feeding mechanism for feeding individual sheets separately from a stack comprising:

a main hopper assembly for supporting a stack of sheets;

means for drawing an exposed edge of an outer sheet away from the remaining stack;

a pull-foot moveable between a first position in which it is between the remaining stack and the edge of the outer sheet which has been exposed and a second position in which it is away from the hopper assembly; and roller means arranged to cooperate with the pull-foot, for pinching the edge of the outer sheet between it and the pull foot while rolling on the sheet as the pull-foot moves away from the remaining stack and pulls the outer sheets from the remaining stack;

the improvement wherein said roller means comprises a driving means including a driving shaft for rotating a carrier fixedly mounted on said driving shaft about a driving-shaft axis, a roller segment pivotally mounted on said carrier at a pivot axis offset from said axis of said driving shaft, and a biasing means mounted between said carrier and said roller segment to bias said roller segment to rotate about its pivot axis toward said pull foot, said roller segment having a surface for pinching the edge of the outer sheet between it and the pull-foot while rolling on the sheet in response to rotation of said driving shaft.

2. In a sheet feeding mechanism as in claim 1 wherein said biasing means is a spring, said spring biasing said roller segment toward said pull foot when said surface is rolling on said sheet.

3. In a sheet feeding mechanism as in claim 2 wherein the range of pivotal movement of said roller segment on said carrier in a second direction is limited by an adjustable stop.

4. In a sheet feeding mechanism as in claim 3 wherein said pull-foot includes a means for biasing said pull-foot toward said first position but said pull-foot is free to be carried toward said second position by said roller segment.

5. In a sheet feeding mechanism as in claim 1 wherein said pull-foot includes a means for biasing said pull-foot toward said first position but said pull-foot is free to be carried toward said second position by said roller segment.

6. In a sheet feeding mechanism as in claim 5 wherein is further included a cam for contacting said pull-foot and controlling the rate at which said pull-foot moves toward said first position.

* * * * *